US005249937A

United States Patent [19]

Aubert

[11] Patent Number: 5,249,937

[45] Date of Patent: Oct. 5, 1993

[54] PERISTALTIC PUMP WITH THREE LOCKINGLY SEALED MODULES

[75] Inventor: Christophe Aubert, Fontainemelon, Switzerland

[73] Assignee: SMH Management Services AG, Biel, Switzerland

[21] Appl. No.: 896,581

[22] Filed: Jun. 10, 1992

[30] Foreign Application Priority Data

Jun. 12, 1991 [FR] France ..... 91 07358

[51] Int. Cl.[5] ..... F04B 43/12

[52] U.S. Cl. ..... 417/475; 417/477

[58] Field of Search ..... 417/474, 475, 476, 477, 417/478, 479; 604/153, 130

[56] References Cited

U.S. PATENT DOCUMENTS

| | | | |
|---|---|---|---|
| 3,249,059 | 5/1966 | Renn | 417/477 |
| 3,429,624 | 2/1969 | Freshwater | 417/476 |
| 3,942,915 | 3/1976 | Thomas | 417/477 |
| 4,187,057 | 2/1980 | Xanthopoulos | 417/477 |
| 4,537,561 | 8/1985 | Xanthopoulos | 417/477 |
| 4,544,336 | 10/1985 | Faeser et al. | 604/153 |
| 4,673,334 | 6/1987 | Allington | 417/477 |
| 4,685,902 | 8/1987 | Edwards et al. | 604/153 |
| 4,735,558 | 4/1988 | Kienholz et al. | 417/477 |
| 4,925,376 | 5/1990 | Kahler | 417/476 |
| 5,083,908 | 1/1992 | Gagnebin et al. | 417/477 |

FOREIGN PATENT DOCUMENTS

| | | | |
|---|---|---|---|
| 19817 | 12/1980 | European Pat. Off. . | |
| 120284 | 10/1984 | European Pat. Off. . | |
| 388787 | 9/1990 | European Pat. Off. . | |
| 2262209 | 9/1975 | France . | |
| 3275988 | 12/1991 | Japan | 417/478 |

*Primary Examiner*—Richard A. Bertsch
*Assistant Examiner*—Roland G. McAndrews, Jr.
*Attorney, Agent, or Firm*—Pollock, Vande Sande & Priddy

[57] ABSTRACT

A medical peristaltic pump having improved pumping and sealing qualities, as well as providing increased flexibility of use and a high level of security. The pump is assembled from at least three modules, a pump rotor (22) being housed in a first module (36; 172) for compressing at least one tube (28; 28*a*; 28*b*) connecting a reservoir (30) for storing a liquid substance to the output (32) of the pump. The compression is effected against at least one support piece (34) of a second module (38, 174). The first and second modules are provided with first positioning elements and first assembly elements in a manner to define a set of two modules for compressing the tube to pump the liquid substance. The set of two modules and a third module (40, 176) are provided with second positioning elements and second assembly elements in a manner such that, once assembled, the third module (40, 176) assures sealing of the first module.

17 Claims, 11 Drawing Sheets

PERISTALTIC PUMP WITH THREE LOCKINGLY SEALED MODULES

The present invention concerns a peristaltic pump provided with means for improving its pumping and sealing qualities and for increasing the flexibility of utilization while conserving a high level of security. Peristaltic pumps are well known and have been used in particular in the medical domain during several years. Such pumps enable administration of a medication in small doses and continuously to a patient by the intravenous route.

BACKGROUND OF THE INVENTION

Because such pumps are generally miniaturized and portable, in order that the patient may circulate freely without being confined to bed and without being under permanent medical supervision, it is indispensable that such pumps be very reliable and provided with security arrangements.

The principle of such pumps is as follows. It consists in using a tube of deformable plastic material which is locally crushed against a fixed casing by means of a rotor driven in rotation by a motor and equipped with presser rollers. The successive pressures exerted by the rollers onto the tube enable drawing in liquid contained in a reservoir and rejecting it through the tube towards the output of the pump. Thus one displaces through the tube a pocket of liquid included between two successive rollers.

It will be readily understood that the distance between each presser roller and the casing against which the tube is crushed must be precisely adapted so as to crush the tube correctly. Effectively, if the presser roller is too close to the casing, it will crush the tube too heavily so that it runs the risk of being deformed and elongated. Inversely, if the tube is not correctly crushed, the pump will not provide the proper quantity of medication.

Consequently, the pump is not reliable which can be dangerous for the patient.

Such problems may arise particularly in pumps of the prior art formed in two modules, such latter being unitable at the moment of utilization thereof. Effectively, in the medical domain, it is frequently sought to provide a pump in two modules, one module containing the elements which must be sterilized and another module containing the elements which cannot resist sterilization. For example one may have one module which contains the rotor and the motor, and one module which contains the reservoir, the tube and the casing. When such two modules are manually assembled, the distance between the rollers of the rotor and the casing is not precise and the problems previously evoked may arise. It is necessary to add to that the dimensional differences of the pump elements due to manufacturing tolerances.

FIGS. 1, 2 and 3 here attached are schematics illustrating the different problems which may arise in this type of prior art pump in two modules.

Such pumps comprise a motor module 1 and a reservoir module 2. The motor module 1 comprises a gripping head 3 and a rotor 4 provided with presser rollers 5. Such module 1 is designed in order to be introduced into the interior of reservoir module 2 in a cavity 6 provided to such effect (arrow SI, introduction sense). The reservoir module 2 comprises a reservoir of liquid 7 coupled by a tube 8 to a needle 9 placed at the output of the pump. The needle 9 is implanted into the circulatory system 10 of the patient. A portion of tube 8 is placed in front of the bottom of cavity 6 which constitutes a support zone 11.

Module 1 is introduced to the interior of the reservoir module 2 in a manner such that on the one hand presser rollers 5 crush tube 8 against the support zone 11 (zone A) and on the other hand the gripping head 3 comes into contact with the periphery of the entry of cavity 6 (zone B), in order to assure impermeability of the pump. Nevertheless, taking into account the manufacturing tolerances of the elements of the different modules, these two conditions are practically never obtained simultaneously. FIGS. 1, 2 and 3 illustrate such contact problems, the distances between such different elements having been exaggerated in order to facilitate explanation thereof.

In the case shown on FIG. 1, the distance between the presser roller 5 and the support zone 11 is too great and tube 8 is not crushed. In this situation the liquid is no longer pumped and remains stationary within tube 8. In an extreme case, the blood of the patient may even risk flowing back to the interior of the pump (arrow F).

In the case shown on FIG. 2, the distance between the presser roller 5 and the support zone 11 is too small and tube 8 is too heavily compressed. Consequently, the liquid no longer circulates within tube 8, the motor driving the rotor 4 is forced to provide a higher couple in order to attempt to overcome such blocking and tube 8 is deformed. Finally, the pump runs the risk of being blocked. Tube 8 may also be too heavily compressed because of a variation of its dimensions due to manufacturing tolerances. Effectively, if tube 8 exhibits over one of its sections a diameter greater than the average diameter for which the distance between the support zone 11 and rollers 5 has been calculated, it will be completely crushed.

FIG. 3 shows a third type of problem. Tube 8 is correctly crushed (zone A), but the contact between the gripping head 3 and the periphery of cavity 6 (zone B) is not perfect. The result thereof is that the pump is no longer impermeable. Thus, when for instance the user washes himself, there is a risk of water penetrating to the interior of the pump and damaging it, in particular in damaging the driving mechanism of the rotor or in bringing about a short-circuit of the battery energizing the motor.

The invention has as its purpose to overcome these difficulties and to increase the flexibility of utilization of peristaltic pumps while assuring a high level of safety.

SUMMARY OF THE INVENTION

To this end, the invention concerns a peristaltic pump having at least three modules permitting the administration of a liquid substance and including the following elements:

pumping means comprising a rotor exhibiting at least one stage having at least one presser roller, such roller locally compressing at least one tube coupling a reservoir for storing the liquid substance to the output of the pump, such compression being effected against at least one support piece, motor means for operating the pumping means.

According to the characteristics of the invention, said pumping means from part of a first module and the support piece forms part of a second module, the first and second modules being provided with and first assembly means serving to form a set of two modules and to define an optimum distance between each presser roller and the support piece. The set of two modules and a third module are provided with second assembly means allowing the assembly of the set of two modules with the third module so as to assure sealing of the first module.

Thus, thanks to the first positioning means, one may precisely define the distance between the presser rollers and the support piece and overcome the pumping problems and in an independent manner, thanks to the second positioning means, one may bring about precise placing of such two modules within the third and resolve the sealing problems.

In a preferred manner, the third module comprises a casing provided with an outwardly opening cavity, the second module is lodged within such cavity and the first module is designed to be introduced to the interior of such cavity along a rectilinear path defining an insertion axis up to the point of being assembled with the second module thanks to the first assembly means and thus to form a set of modules located in a first intermediate insertion position. Thereafter, such set of modules is designed so as to be displaced along said insertion axis from such first position up to a second and final insertion position in which it is assembled with the third module by the second assembly means.

Thanks to these characteristics, the first two modules may be precisely assembled during a first stage in order to obtain a correct assembly of the pumping means, then in the course of a second ulterior stage one may assemble such two modules with the third in order to obtain impermeability of the pump.

According to an additional characteristic of the invention, the support piece is a block which opens out in substantially V form and it is hollowed out parallel to the bottom of such V-shaped opening within its thickness so as to define at least one elastic wall which is deformable under the action of the presser rollers. The tube in which the liquid circulates is locally compressed against such elastic wall.

This characteristic enables a further improvement of the pumping qualities of the pump acording to the invention. In effect, if such tube exhibits variations in diameter due to manufacturing tolerances, the elastic wall of the support piece may be deformed in a manner to compensate for such variations. Consequently, the tube will always be correctly crushed and the motor will not be required to supply an additional couple in order to crush such tube.

It follows therefrom that the pump may be constructed using a motor which furnishes a smaller couple thus consuming less energy and that one may employ a battery of lower voltage, thus lighter and less voluminous. Overall, the pump is thus less voluminous and lighter than pumps of the prior art and it is also less expensive.

Finally, according to another characteristic of the invention, the first module comprises a gripping head designed in such a manner that it masks a filling orifice of the storage reservoir when the first and second modules have been assembled, thus preventing access to such orifice by a syringe needle for instance. From this characteristic the result is that it is no longer possible to modify the contents of the storage reservoir once the first and second modules are assembled. Thus it is possible to define the contents of the storage reservoir and to place the peristaltic pump in an intermediate insertion position in which it is no longer possible to modify the contents of the storage reservoir, such pump having then not yet been started. The flexibility of use of the pump is thus increased while conserving the high level of security necessary in the medical domain.

BRIEF DESCRIPTION OF THE DRAWINGS

The invention will be better understood upon reading the following description given by way of an illustrative example and prepared with reference to the attached drawings in which.

DESCRIPTION OF THE PREFERRED EMBODIMENTS

Figure 4:
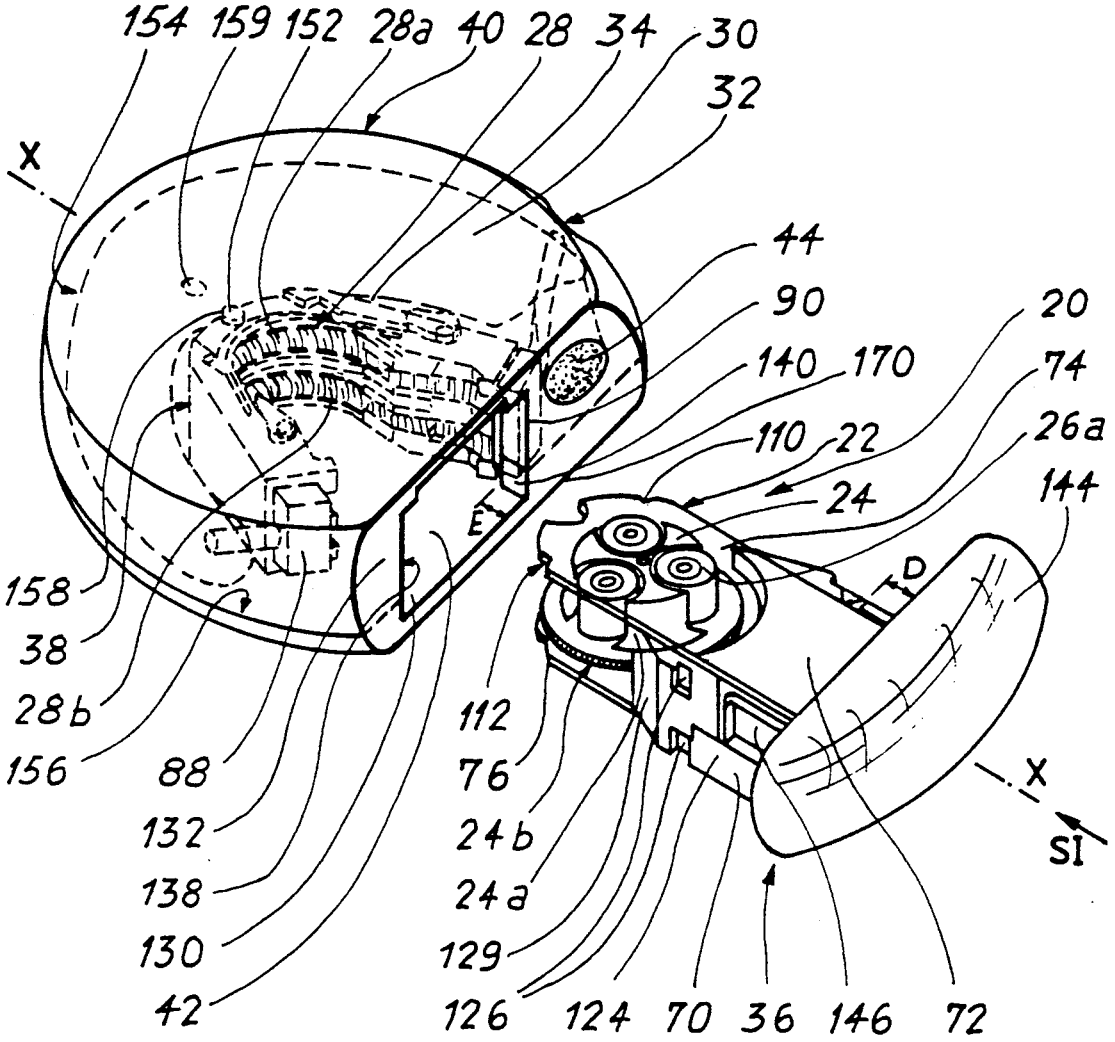
FIG. 4 is a perspective view of an embodiment of the peristaltic pump according to the invention, the three modules constituting such pump not having been assembled.

FIG. 4 illustrates a peristaltic pump according to the preferred embodiment of the invention.

Figure 5:
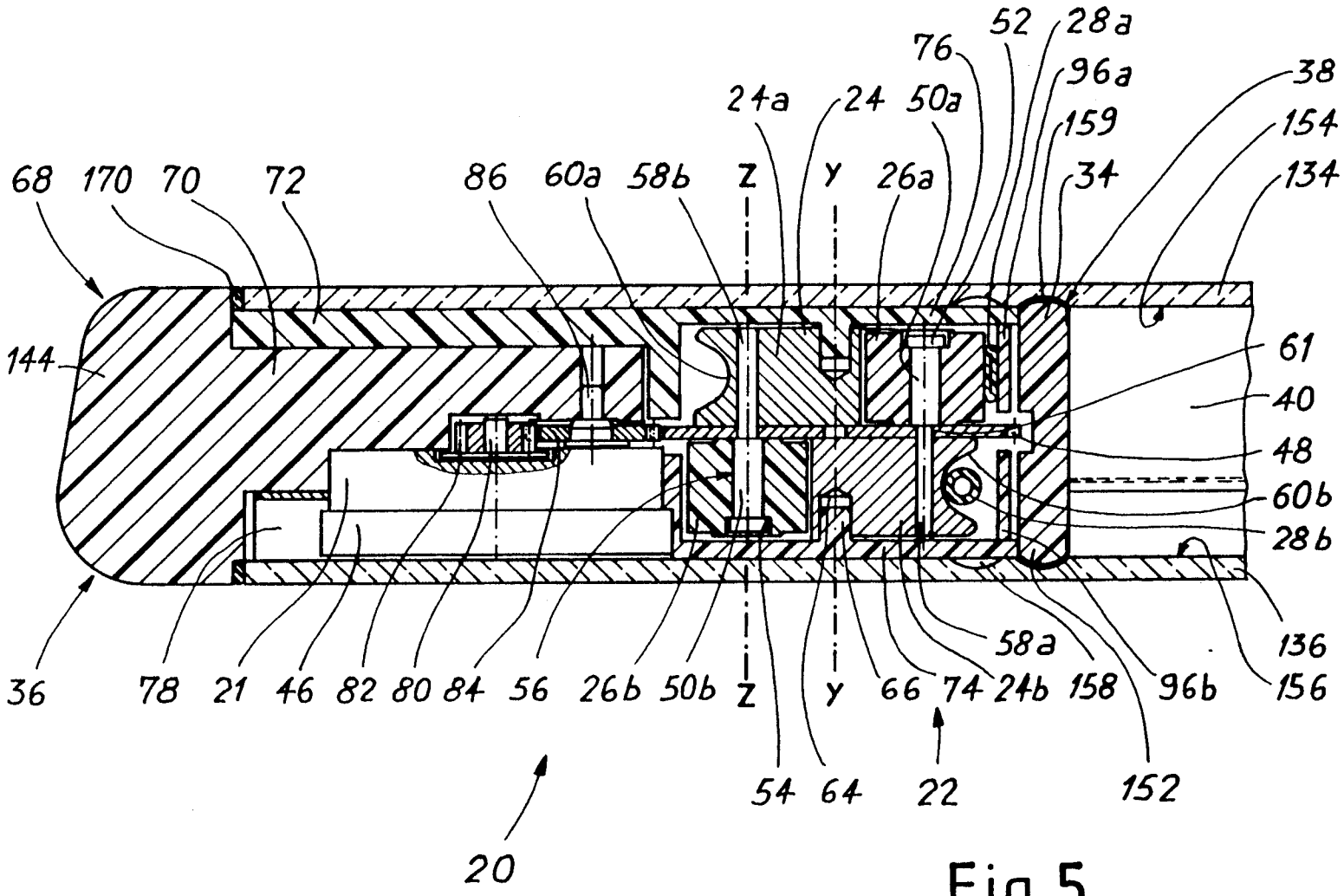
FIG. 5 is a partial cross-section of the peristaltic pump along line V—V of FIG. 11.

Such pump permits administration of a liquid substance and comprises in the standard manner:

pumping means 20 for said liquid substance, and motor means 21 in order to operate them (such motor means 21 are illustrated solely on FIG. 5).

The pumping means 20 comprise a rotor 22 exhibiting at least one stage having at least one presser roller. In the embodiment shown, the rotor formed by a body 24 exhibits two stages, a first stage 24*a* including three presser rollers 26*a* and a second stage 24*b* likewise comprising three rollers (not visible on FIG. 4) and angularly shifted by 60° relative to rollers 26*a* of the first stage. The rollers of the lower stage 24*b* on the other hand appear on FIG. 5 and are referenced 26*b*.

According to the standard principle of peristaltic pumps, such rollers are designed to compress locally at least one tube 28 coupling a storage reservoir 30 for said liquid substance to the output 32 of the pump. Such compression is effected against a support piece 34.

According to the preferred characteristics of the invention, the pump comprises a first module 36 comprising the motor means, a second module 38 comprising the support piece 34 and a third module 40 comprising the storage reservoir 30.

In order that the pump may function, such three modules must be assembled.

Consequently, the first module 36 and the second module 38 are provided with first means for positioning them relative to one another and first assembly means permitting definition of a set of two modules in which the distance between each presser roller 26*a*, 26*b* and the support piece 34 enables a necessary and sufficient crushing of the tube 28 in order to pump efficiently said liquid substance. Such first positioning means and first assembly means are described and referenced subsequently.

Such set of two modules 36, 38 and such third module 40 are also provided with second positioning means and second assembly means which will be described and referenced subsequently and which permit, once the three modules 36, 38, 40 are assembled, to obtain sealing of the pump. One may see on FIG. 10 that the set of the two modules 36, 38 is at least partially housed within the third module 40.

In order that these three modules may be assembled, the third module 40 exhibits the general form of a hollow casing defining an outwardly opening cavity 42, in the interior of which is housed the second module 38. The first module 36 has substantially the form of a drawer which may be introduced within said outwardly opening cavity 42 along a rectilinear path defining an insertion axis X—X up to the point of being assembled with the second module thanks to said first assembly means (see FIG. 10).

Reservoir 30 for the liquid substance is arranged within the outwardly opening cavity 42 of the third module 40, mainly at the bottom and along the sides of the latter, and behind the second module 38 (relative to the insertion sense arrow SI). The output 32 of the pump may be coupled for instance to a hypodermic needle or to an intravenous needle implanted in the body of the patient. Finally, this reservoir 30 may be filled thanks to a filling orifice 44 of the septum type.

The pump according to the invention will now be described in further detail. As illustrated on FIG. 4, the first module 36 exhibits a generally elongated form and comprises in its narrower forward portion the rotor 22 and in its larger back portion the motor means 21 as well as the control means 46 (not shown on this figure, but appearing on FIG. 5).

The rotor 22 appears in greater detail on the cross-section shown on FIG. 5. As previously described, this rotor comprises thus a body 24 of generally cylindrical form, the axis Y—Y of which serves as rotation axis. The upper and lower portions of this body define two stages 24*a* and 24*b* on either side of a radial median plane on which is provided a toothed crown 48 intended to assure driving of said rotor in rotation. This crown 48 extends beyond the general shell of the cylindrical body 24 which thus exhibits at this place its greatest diameter.

On each stage 24*a*, 24*b* are provided three spindles respectively 50*a*, 50*b* intended to receive presser rollers as previously described, such spindles showing axes ZZ parallel to axis Y—Y. The three spindles of each stage are angularly separated among themselves by 120° and spindles 50*a* of the upper stage 24*a* are shifted by 60° relative to spindles 50*b* of the lower stage 24*b*.

Each spindle 50*a*, 50*b* shows at its free end an annular flange 52 forming a shoulder 54. On each stage the three presser rollers respectively 26*a*, 26*b* are engaged on respective spindles 50*a*, 50*b* in being held in place by latching against the shoulder 54. To this end, each roller, which exhibits a substantially cylindrical form, has a coaxial opening orifice 56 intended to accommodate one of said spindles. Furthermore, each spindle 50*a*, 50*b* is extended by a stem respectively 58*a*, 58*b* of smaller diameter. Additionally, on each stage, body 24 shows three grooves 60*a*, 60*b* opening out on their lateral surface and having substantially in cross-section, the form of a V with a rounded point.

Each groove 60*a*, 60*b* is provided between two neighboring rollers of the same rotor stage.

Each stem 58*a*, 58*b* of a spindle 50*a*, 50*b* extends over the entire height of body 24 of the rotor 22 and traverses the toothed crown 48 from one side to the other through an orifice 61.

Centered on its axis Y—Y, body 24 also includes two blind holes 64 in which are engaged respectively pivots 66 making up part of a block 68 forming the structure carrying the motor means 21.

Block 68 comprises a body 70 and a covering plate 72 preferably formed of transparent plastic material. Each of the body 70 and the cover plate 72 respectively presents a projecting part 74, 76, such two parts constituting a yoke in order to permit the assembly in rotation of rotor 22. Pivots 66 are respectively integral with the projecting parts 74, 76.

Additionally, body 70 exhibits a cavity 78 serving for housing the motor means 21 and control means 46. Such motor means comprise a driving motor of which the output shaft 80 bears a pinion 82 meshing with an intermediate wheel 84 mounted for rotation on a stud 86 provided in this cavity. Subsequently, the intermediate wheel 84 meshes with the toothed crown 48 of rotor 22.

Such motor means 21 and such control means 46 may be constructed by using a standard watch movement in which the axis of the hours hand constitutes the output shaft 80. Such watch movement is energized by a button cell (not shown on FIG. 5).

Furthermore and as illustrated on FIG. 4, the tube 28 comprises in fact (in the special case of a rotor having two stages of presser rollers), two tubes 28*a*, 28*b*, one for each roller stage. Such tubes 28*a*, 28*b* pass around the peripheral portion of the rotor when the latter is mounted on the support piece 34. Such tubes come together at the corresponding ends by Y connections 88, 90, connection 88 being connected to the reservoir 30 (suction side of the pump), while connection 90 communicates with the output 32 (ejection side of the pump). Such tubes 28*a*, 28*b* are crushed by the rollers of rotor 22 against the support piece 34 constituting the second module 38 and which will now be described.

Figure 6:
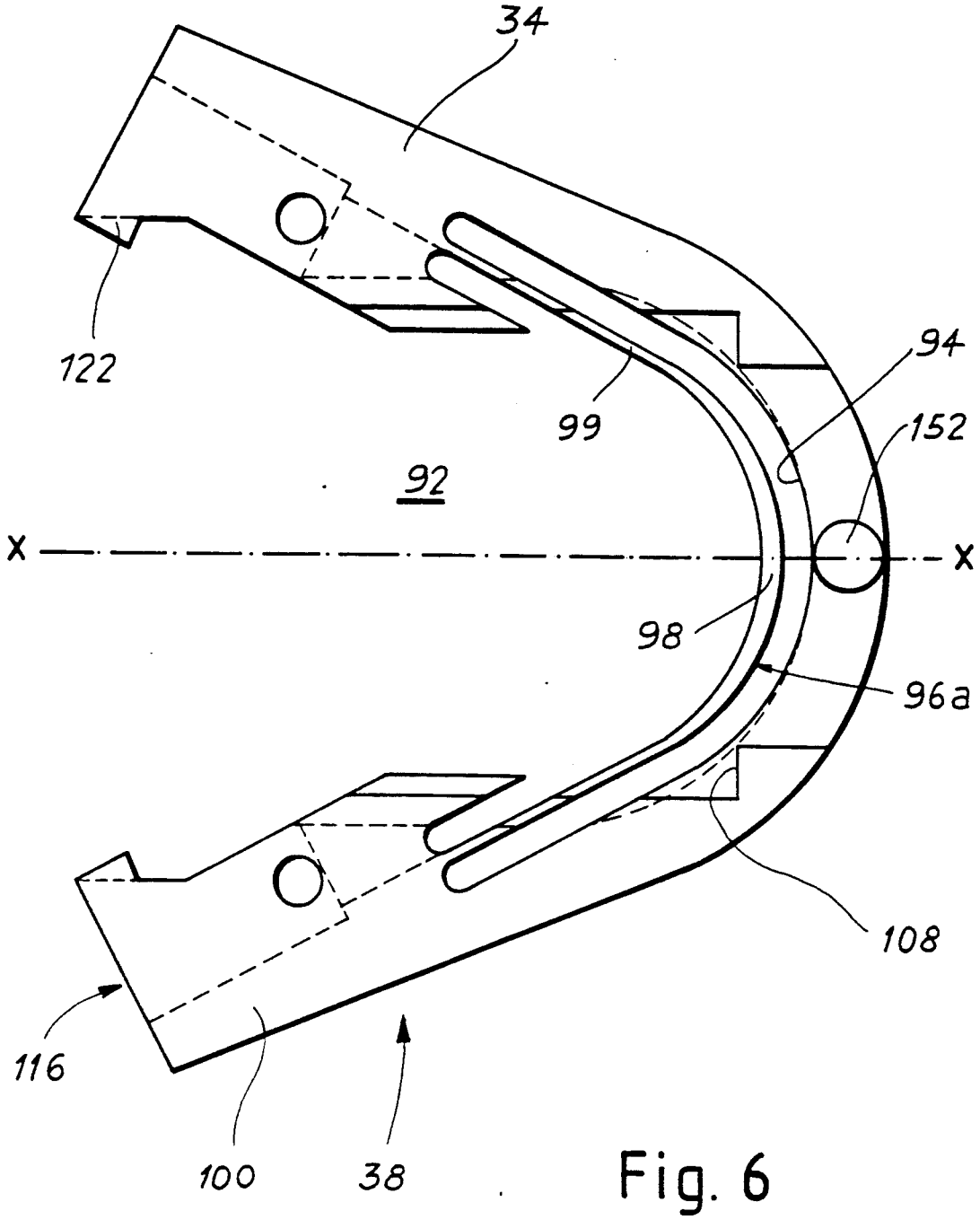
FIG. 6 is a top view of the second module.
Figure 7:
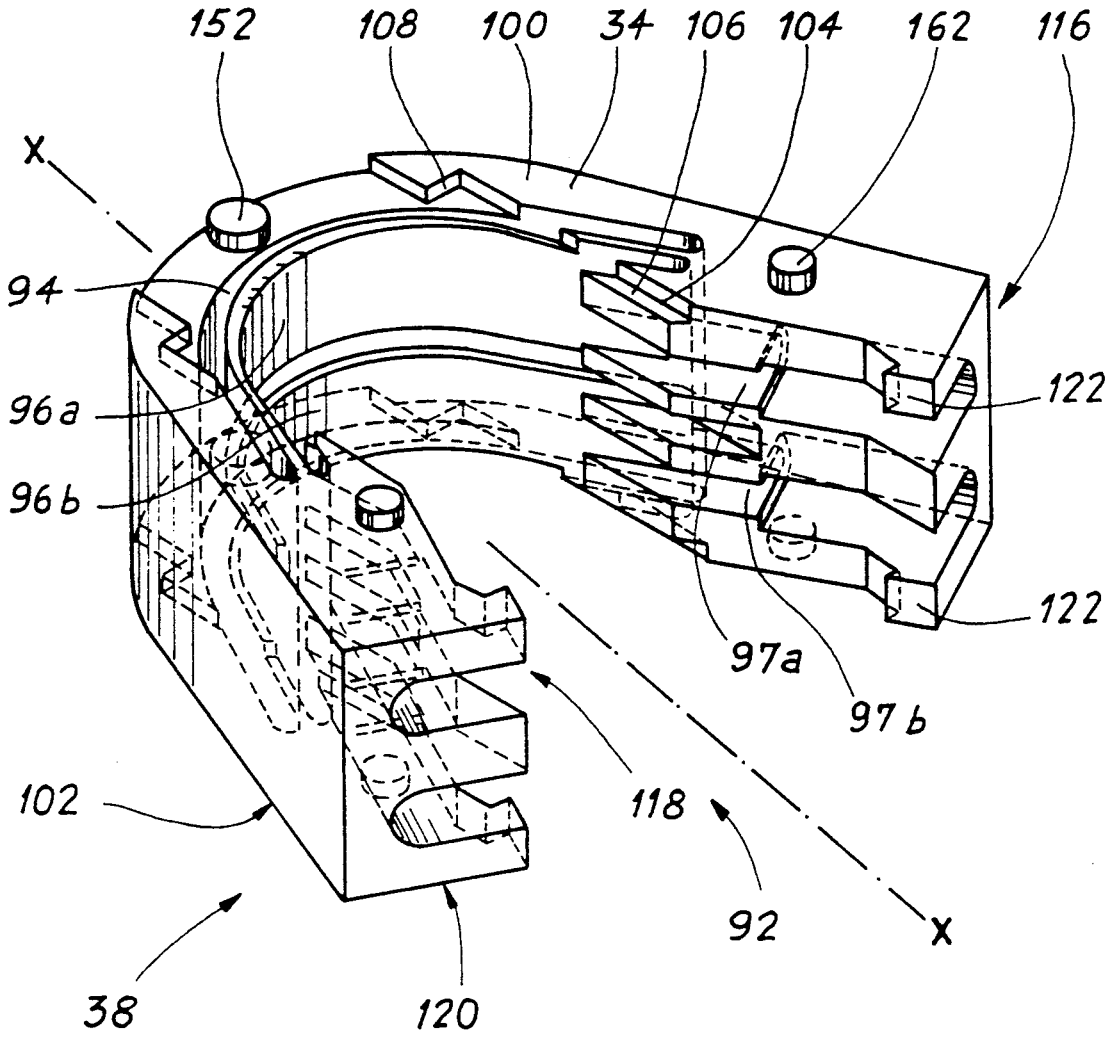
FIG. 7 is a perspective view of the second module.

FIGS. 6 and 7 illustrate more specifically such support piece. The support piece 34 is a block which opens out substantially in a V form 92 with a rounded point. Such support piece is hollowed out parallel to the bottom of its V opening within its thickness in order to form a recess 94 in a manner to define two superposed elastic walls 96*a*, 96*b* corresponding to the two stages 24*a*, 24*b* of rotor 22. The two tubes 28*a*, 28*b* previously described are crushed respectively against such walls 96*a*, 96*b* when rotor 22 is assembled with such support piece 34. Each wall 96*a*, 96*b* is extended at its two ends by gutters 97*a*, 97*b* intended to accommodate the two tubes 28*a*, 28*b* and to support them up to the Y connections 88, 90 (see FIG. 4). This support piece 34 is designed in order that the first module 36 may penetrate to the interior of the V opening 92 along the axis of insertion X—X. Such support piece 34 is also symmetric relative to such X—X axis.

Preferably, such support piece is formed as one piece and injected in an elastic compressible material, for instance in polyoxymethylene (POM) sold under the trademark Hostaform. Nevertheless, such support piece 34 could also be in several pieces formed of different materials. By way of example, the support piece could assume the form of a frame to which would be attached two flexible bands of rubbery or metallic nature.

As appears better on FIG. 6, the deformable elastic wall 96*a* (respectively 96*b*) is thicker at its central portion 98 than at its two end portions 99 so as better to resist the pressures exerted by the presser rollers and not to break.

The special form of walls 96*a*, 96*b* and the fact that they are made of an elastically deformable material permits them to deform under the action of the presser rollers and always to remain at the necessary distance from such rollers in order to obtain a correct crushing of the tube 28. The elasticity of such walls 96*a*, 96*b* enables compensating for the small differences in dimensions due to manufacturing tolerances of the tube 28.

Furthermore, for safety reasons and in particular when the pump is implanted in the venous or arterial circulatory system, the elastic walls 96*a*, 96*b* are designed to resist a certain blood counter-pressure. Thus, even if the motor means 21 were to stop operating in bringing about the stopping of rotor 22 and if the tubes 28*a*, 28*b* were compressed in one or two precise points between said walls 96*a*, 96*b* and the presser rollers 26*a*, 26*b*, the force exerted by the flow of blood in the tube 28*a*, 28*b* (output side of the pump) would not be sufficient to deform such walls 96*a*, 96*b* and permit a return of blood towards the reservoir 30.

In order to answer to medical safety standards, walls 96*a*, 96*b* are designed to resist at least arterial back pressures of 0.3 bar ($0.3.10^5$ Pa). Preferably, they can resist up to a pressure of 1.5 bar ($1.5.10^5$ Pa).

During assembly of rotor 22 with such support piece 34, the first module 36 requires to be guided relative to the second module 38. To this end the upper face 100 and the lower face 102 of the support piece 34 (relative to FIG. 7) exhibit on either side of the axis of symmetry X—X a recess 104 constituting a shoulder 106 forming a guide rail for the bottom of the body 70 and the cover plate 72 of the first module 36 (see FIG. 5). Each guide rail 104 terminates at its end directed towards the point of the V by a counter-abutment surface 108. Such counterabutment surface 108 is oriented substantially perpendicular to the insertion axis X—X. Furthermore and as shown on FIG. 4, the ends of the projecting parts 74, 76 of the body and the cover plate are provided with two notches 110 on each side of the insertion axis X—X exhibiting an abutment surface 112 perpendicular to the axis X—X and cooperating with said counter-abutment surfaces 108. These surfaces of abutment and counter-abutment thus enable limiting the course of the first module 36 once that the latter has been introduced to the interior of the support piece 34. This appears more clearly in FIG. 10. The abutment surfaces 112 and counter-abutment surfaces 108 constitute first positioning means 114 of the first module 36 relative to the second module 38. In a simplified version, the first positioning means 114 could be constituted by a single counter-abutment surface 108 and by a single notch 110.

Furthermore, as may be seen on FIG. 7, each branch of the support piece in V form exhibits at its end 116 two hooks 122 directed towards the interior of such V-formed piece in its upper portion 118 and in its lower portion 120. Furthermore, and as is illustrated on FIGS. 4 and 8, the first module 36 exhibits in its enlarged portion and on its two lateral faces 124 two undercuts 126 intended to cooperate with said hooks 122. Such hooks 122 and undercuts 126 constitute the first assembly means 128 of the first and second module (see FIG. 10). One could also have only a single hook 122 and a single undercut 126 and the latter could be provided on faces other than those mentioned. Between the narrow portion and the widened portion of the first module 36 there is provided an inclined lateral plane 129 on either side of the axis X—X.

The third module is now to be described in greater detail in having reference in particular to FIGS. 4 and 8 to 11. It will be noted that on FIGS. 8 to 11 reservoir 30 and tubes 28*a*, 28*b* have not been shown in order not to overload these figures.

The third module 40 takes the general form of a truncated cylinder. The outwardly opening cavity 42 provided in the thickness has a form substantially similar and the opening 130 of such cavity is located in the truncated surface 132 of the third module (see FIG. 4). The reservoir 30 for the liquid to be administered is arranged substantially at the bottom of cavity 42 relative to the opening 130 and assumes the general form of a crescent. It is arranged around the second module 38. As appears to better effect on FIG. 5, this third module 40 is in fact formed from two half-shells 134, 136 which are ultrasonically welded together during manufacture.

Reservoir 30 is constituted by a bladder in flexible plastic material, for example in PVC (polyvinyl chloride) covered with an impermeable coating or in EVA (copolymer ethylene/vinyl acrylate). The preferred volume of the bladder is on the order of 10 $cm^3$. This volume, however, is given only by way of indication.

Furthermore, the third module 40 exhibits at the level of the substantially rectangular opening 130 of the cavity 42 two lateral walls 138, 140 of thickness E opening thereafter into the actual cavity 42. Such lateral walls 138, 140 define two shoulders 142 (see FIG. 9). Furthermore, the block 68 forming the structure bearing the motor means 21 is extended in its wider part by a gripping head 144 formed by moulding (see FIG. 4). Such gripping head facilitates manipulation of the first module 36 and additionally, once introduced into the third module 40, blocks completely the outwardly opening cavity 42 as well as the access to the filling orifice 44. The first module 46 further shows at least one elastic hook 146 (preferably two) integrally formed with the gripping head 144 and designed to cooperate with the shoulder 142 (preferably both). Such shoulders 142 and elastic hooks 146 constitute the second assembly means 148 of the first module 36 (more precisely, the set of two modules) with the third module 40 (see FIG. 11).

Furthermore, since the distance D between the point 149 of each hook 146 and the gripping head 144 is precisely calculated during moulding of the parts in a manner to correspond to the thickness E of walls 138, 140 of the outwardly opening cavity 42, such hooks 146 and such walls 138, 140 also constitute the second positioning means 150 of the first module 36 with the third module 40.

As illustrated on FIG. 5, the support piece 34 exhibits a projection 152 at the level of its rounded off median portion on its upper face 100 and on its lower face 102. The third module 40 exhibits on each of its respective upper and lower internal faces 154 and 156, two blind orifices 158, 159 intended to cooperate with the projection 152. This projection and the first blind orifice 148 constitute the counter support means 160 of the first module 36 relative to the second module 38 in the first insertion position (see FIG. 8).

As illustrated on FIG. 7, the support piece 42 shows an integrally formed stud 162 on each of the ends 116 of its two branches. Each stud 162 projects from the upper and lower faces respectively 100, 102 of said support piece 42.

Figure 8:
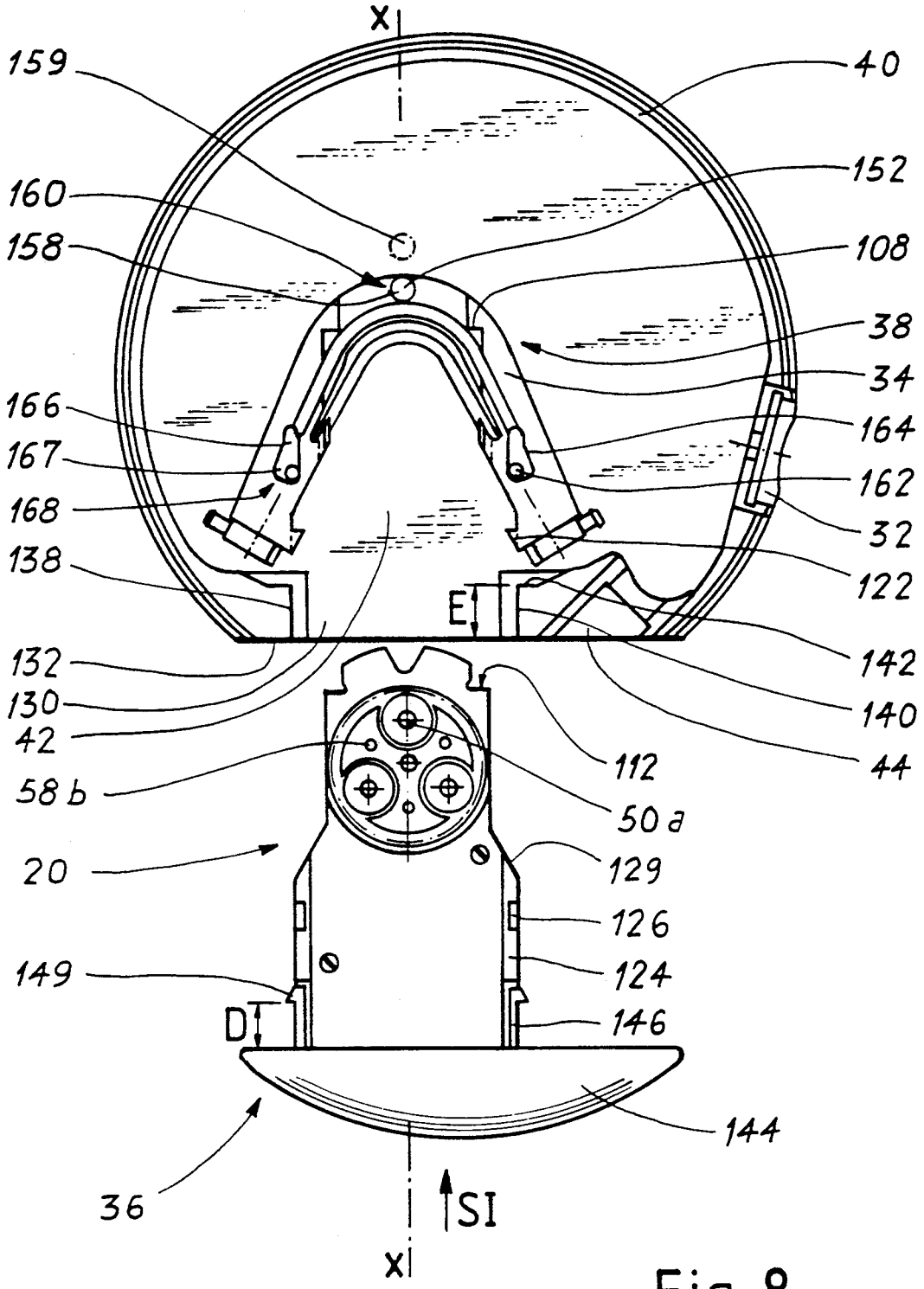
FIG. 8 is a top view of the peristaltic pump of FIG. 4 in which, in order to simplify matters, the reservoir and the tubes have not been shown.
Figure 9:
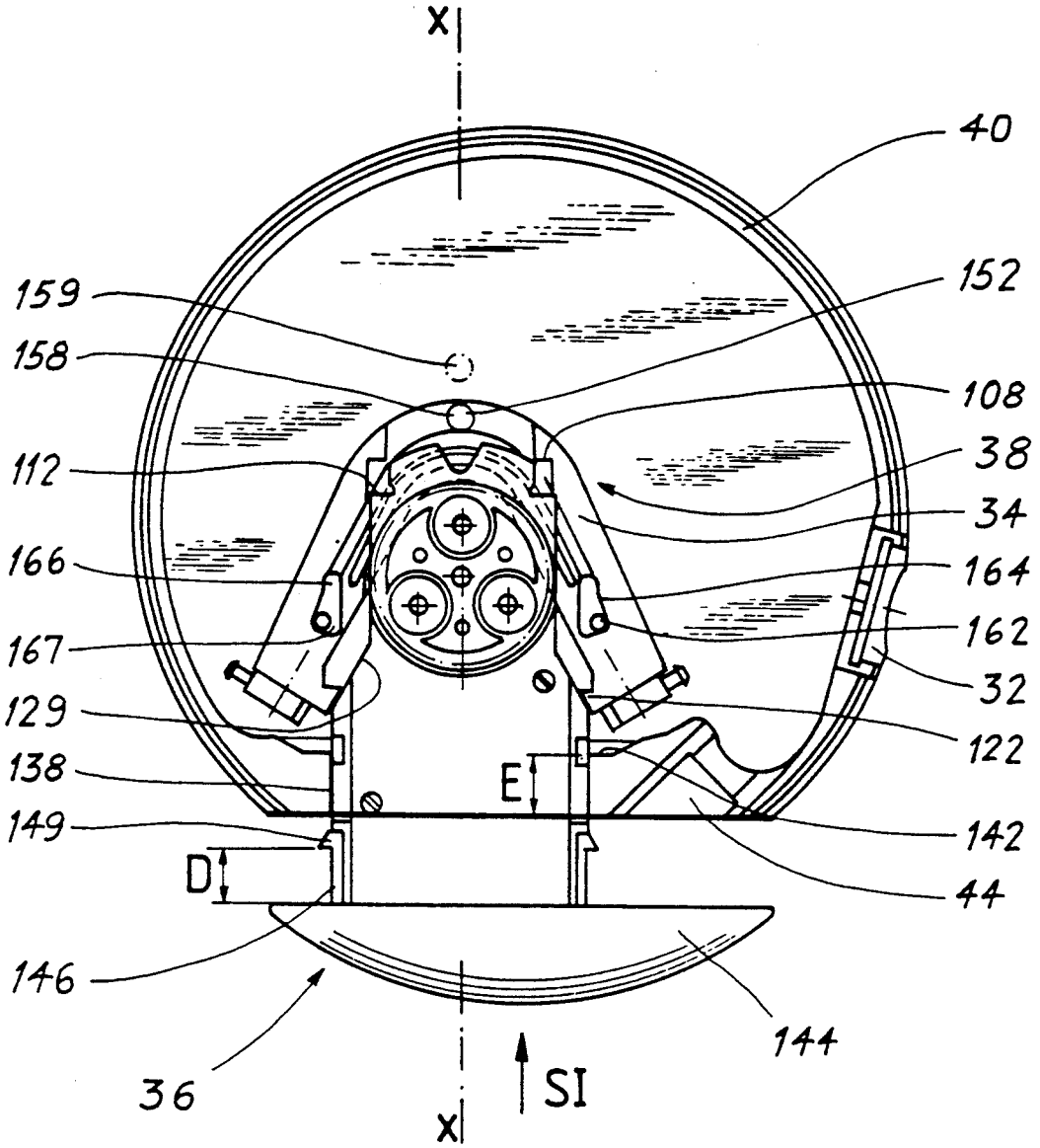
FIG. 9 is a top view similar to FIG. 8, but in which the first module and the second module are almost assembled.

On the other hand, the upper and lower internal surfaces 154 and 156 of the outwardly opening cavity 42 are each provided with two receptacles 166 intended to cooperate with said studs 152 (see FIG. 8). These receptacles are of a substantially oblong form and show developing lateral play which diminishes along the insertion axis X—X. In other words, these receptacles are wider at the open side of the outwardly opening cavity 42 and are narrower towards the bottom of said cavity. Each receptacle 166 shows an inclined plane 164. Studs 162 and receptacle 166 constitute the guide means 168 which will be described in detail hereinafter.

The operation of the peristaltic pump according to the invention will now be described.

When the pump is put into commerce, the third module 40 containing the second module 38 is presented separately from the first module 36. One is in the situation shown on FIG. 8. The nurse may fill reservoir 30 with the help of a syringe, thanks to the septum 44 (see FIG. 4). The second module 38 is positioned within the outwardly opening cavity 42, thanks to the two projections 152 which each cooperate with the two first blind orifices 158 (relative to the sense of insertion, arrow SI), of cavity 42.

The nurse then introduces the first module 36 into the third module 40 and more precisely to the interior of opening 92 in U-form of the second module 38. When the inclined planes 129 come into contact with the triangular hooks 122, the two branches of the second module 38 are outwardly spread because of the inherent elasticity of polyoxymethylene chosen for the manufacture. The studs 162 are displaced into the portion 167 of receptacles 166. This situation is shown on FIG. 9.

Figure 10:
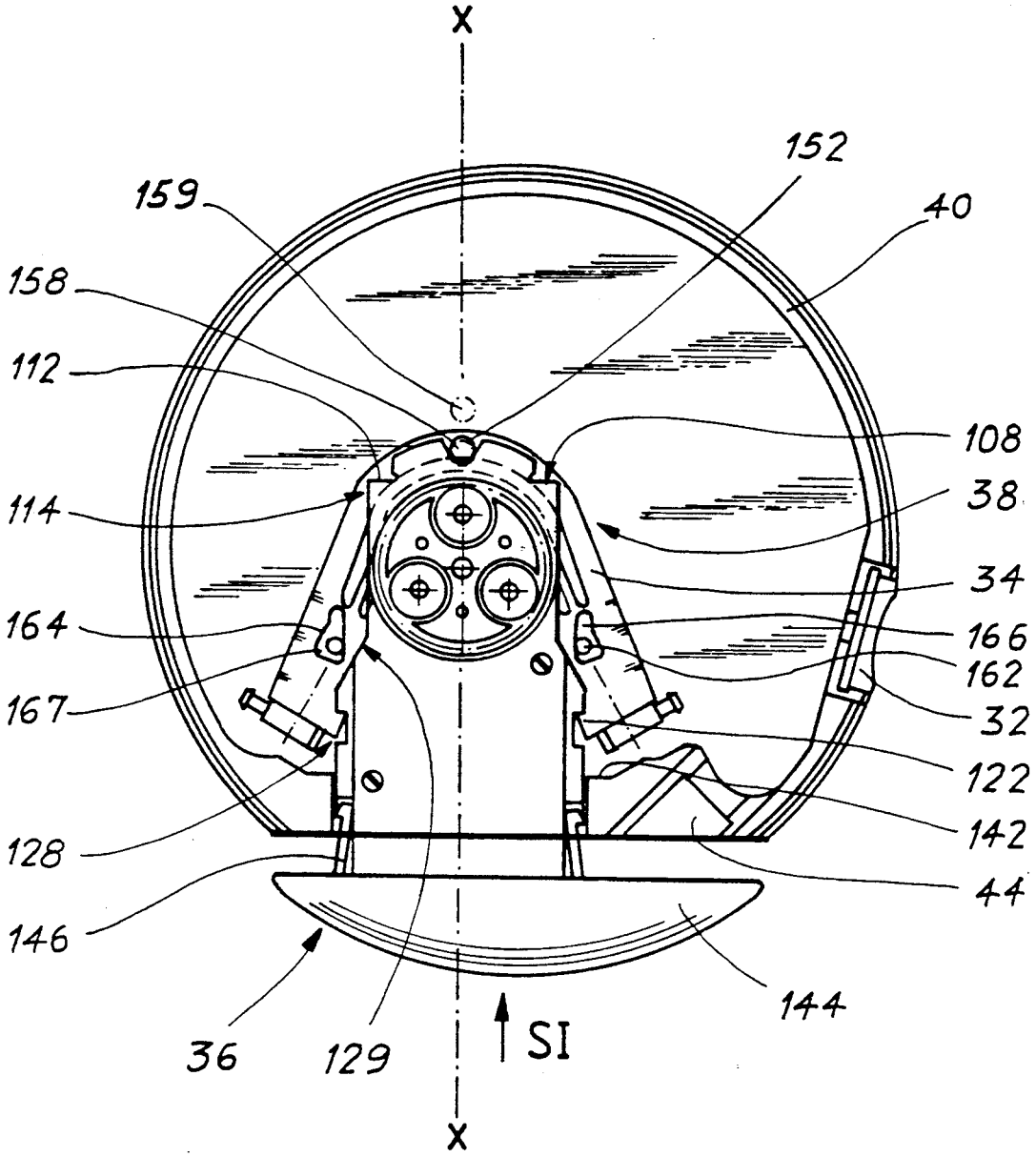
FIG. 10 is a top view similar to FIG. 8, but in which the first module and the second module are assembled.

The nurse continues introducing the first module 136 until the abutment surfaces 112 and counter-abutment surfaces 108 are in contact and simultaneously that hooks 122 are engaged in the undercuts 126 (situation shown on FIG. 10). This latter operation is facilitated by the fact that the studs 162 abut against the inclined planes 164 of the receptacles 166, this having a tendency to bring the two branches of the support piece 34 into their original position.

The set of two modules is in an intermediate insertion position (FIG. 10). Studs 162 are substantially half-way along receptacles 166 and projections 152 begin to come out of the blind orifices 158. Additionally, in this intermediate insertion position, the access to the filling orifice 44 is sufficiently masked to prevent any addition or removal of liquid by means of a needle. It will be noted also that this intermediate insertion position is irreversible, that is to say, it is no longer possible to separate the first module from the third module once the peristaltic pump has been placed into the intermediate insertion position.

Figure 11:
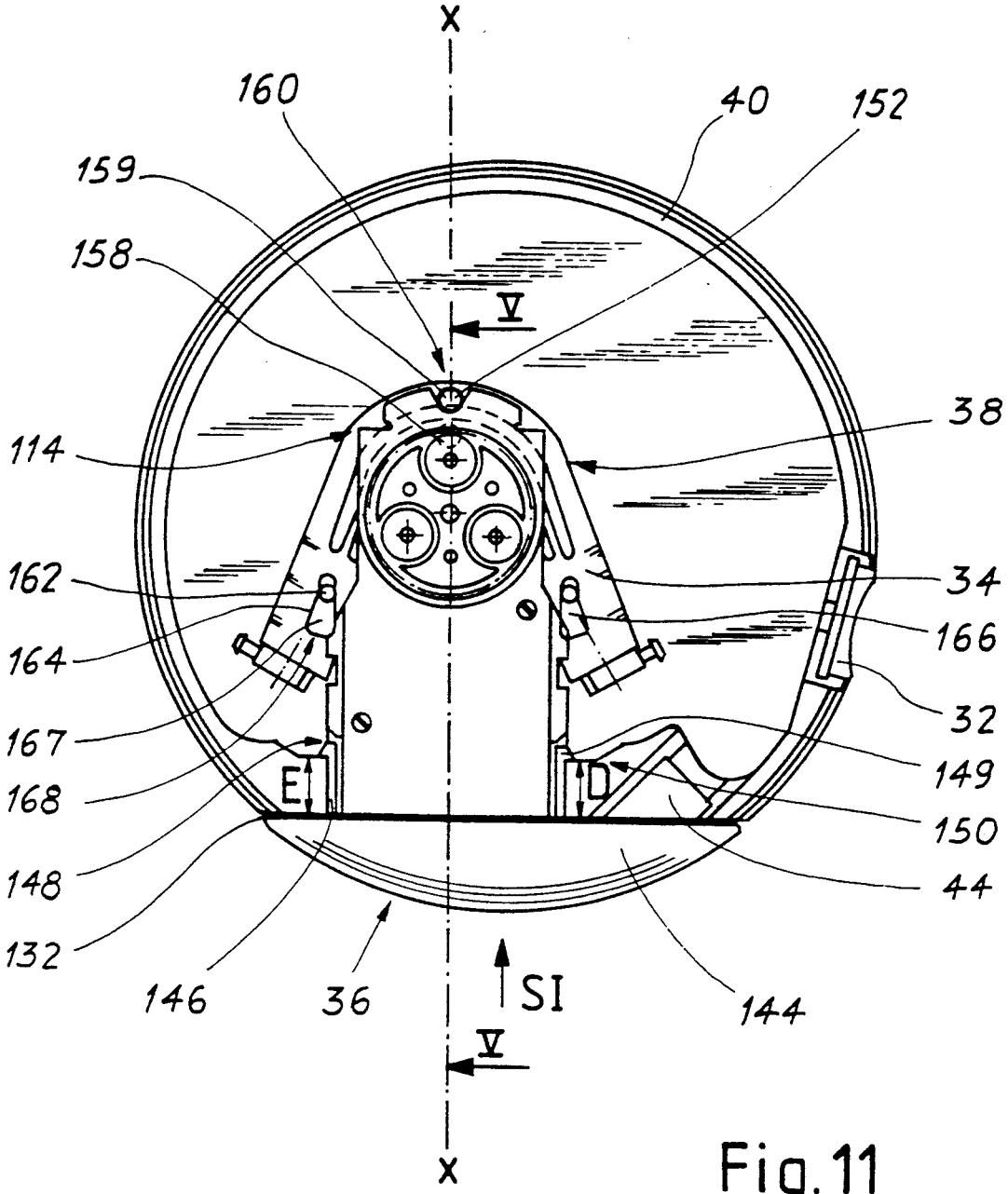
FIG. 11 is a top view similar to FIG. 8 but in which the three modules are assembled.

Thereafter the nurse continues displacement of the first module, or more precisely the set of two modules 36 and 38, in the insertion sense SI until the elastic hooks 146 cooperate with shoulders 142 and the gripping head 144 comes into contact with the cut off surface 132, thus assuring the impermeability of the pump (second final insertion position shown on FIG. 11).

This impermeability is in fact reinforced by a seal 170 attached by gluing on the cut off surface 132 around opening 130 of the third module 40 (FIG. 4).

At the same time, the set of two modules 36, 38 has continued to be displaced toward the interior of the third module 40. The two projections 152 have left the first two blind orifices 158 in order to pass into the two following orifices 159.

It will be noted that studs 162 are also displaced towards the narrower portion (bottom) of the receptacles 166 (FIG. 11).

Figure 1:
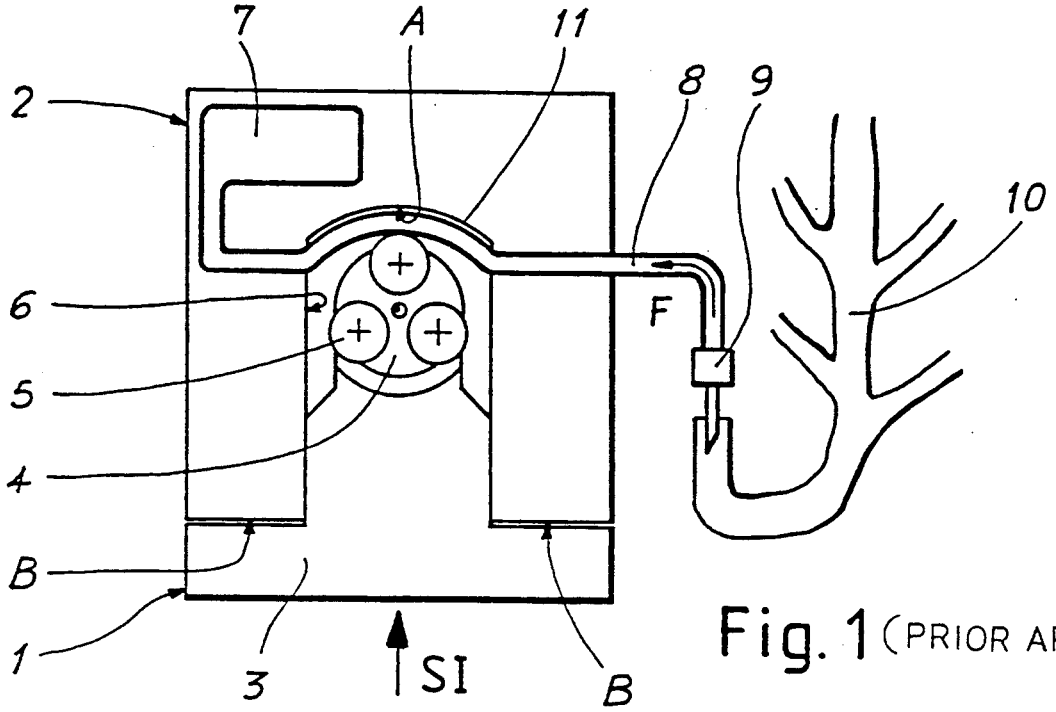
Fig. 1 (PRIOR ART)
FIGS. 1, 2 and 3 are schematic drawings illustrating the problems posed by prior art pumps.
Figure 2:
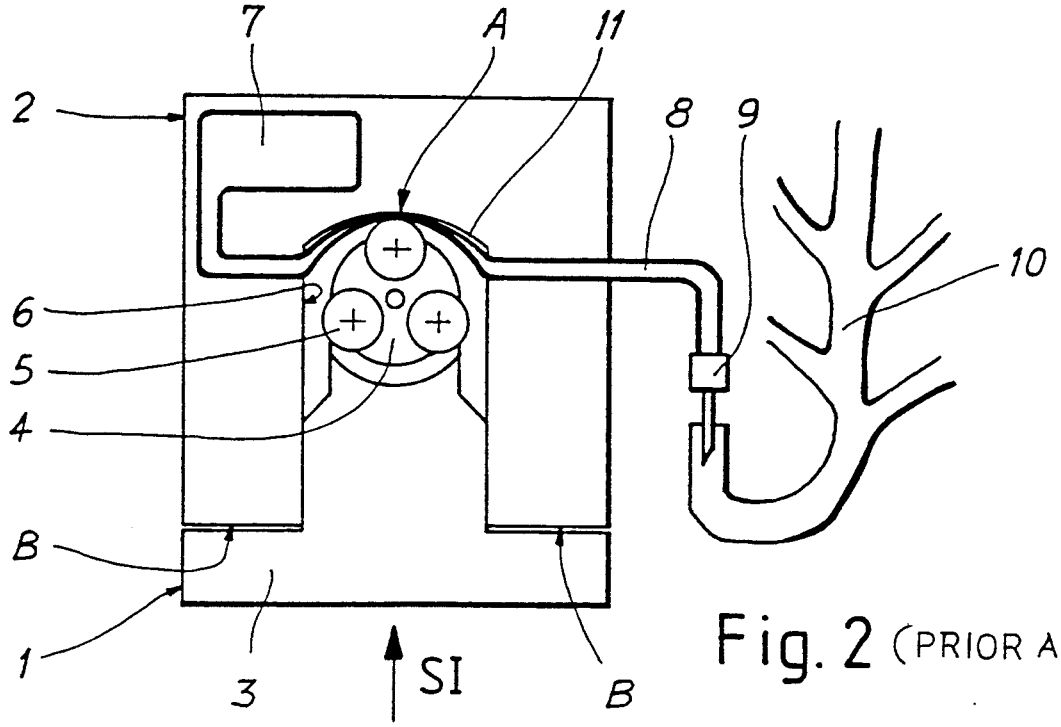
Fig. 2 (PRIOR ART)
Figure 3:
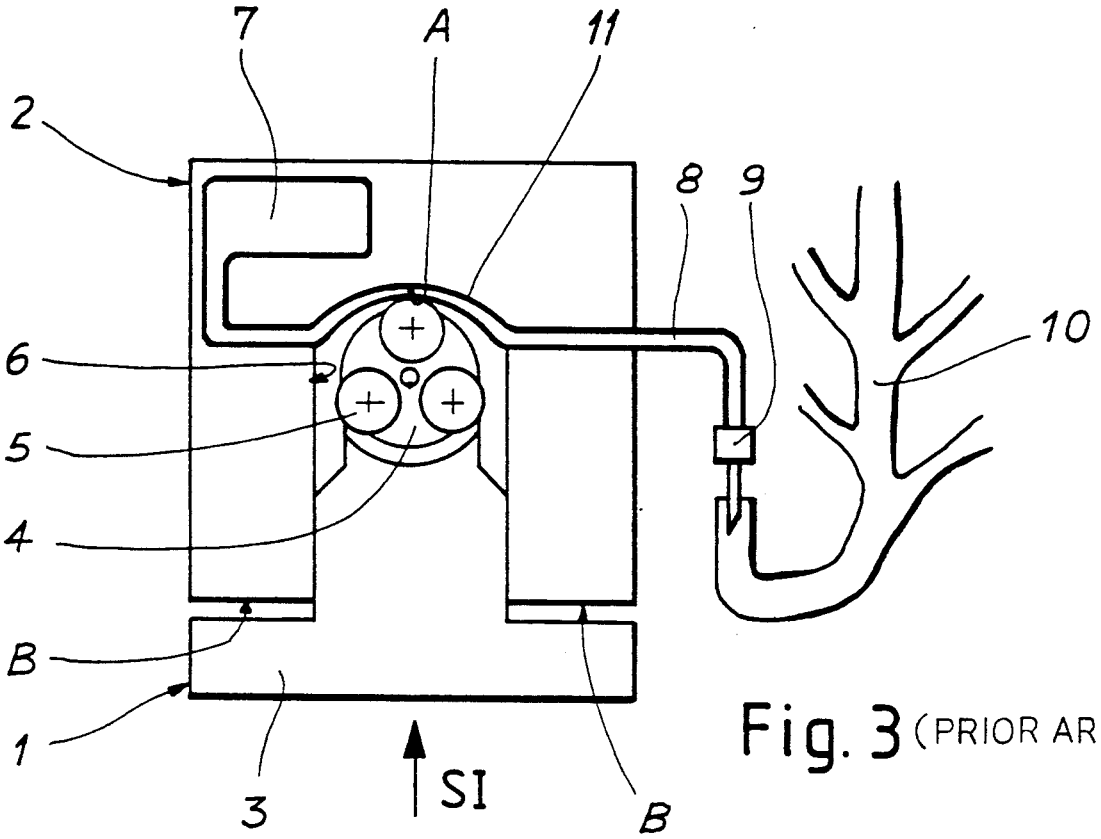
Fig. 3 (PRIOR ART)

Thanks to these characteristics, the invention resolves the problem of double contact points of the prior art pumps (zones A and B on FIGS. 1 to 3). Effectively, when one introduces the first module 36 to the interior of the second module 38 only the contact point between the abutment and counter-abutment surfaces 112 and 108 is brought about, the undercuts 126 being slightly larger than hooks 122 and thus there is no fixed second contact point between these two modules.

In the same manner, when one displaces the set of the two modules to the interior of the third, one stops at the moment when the gripping head 144 comes into contact with the cut off surface 132.

There one further has a single contact zone since orifices 159 are larger than projections 152. The latter thus do not constitute a terminal abutment for the set of two modules 36, 38.

Next another essential advantage of this arrangement comes from the fact that in its intermediate insertion position the filling orifice 44 of reservoir 30 is masked, preventing any variation of the contents of such reservoir by the aid of any syringe whatsoever. Thus, being given that this intermediate insertion position is irreversible and that in this position the motor of the peristaltic pump has not yet been started, it is possible with all security required by the medical domain that a qualified person fills the reservoir and introduces the first module 36 into the third module 40 until they are placed in the intermediate insertion position. From this moment the peristaltic pump may be taken over by a less qualified person and be installed eventually on the patient, the complete sealing assuring the impermeability of the assembly and starting the operation of the motor serving to operate the pump taking place once the installation on the patient has taken place.

Finally, to obtain the same advantages concerning pumping and sealing as those claimed in this application, one may also provide a second embodiment of the invention which will now be summarily described.

Figure 12:
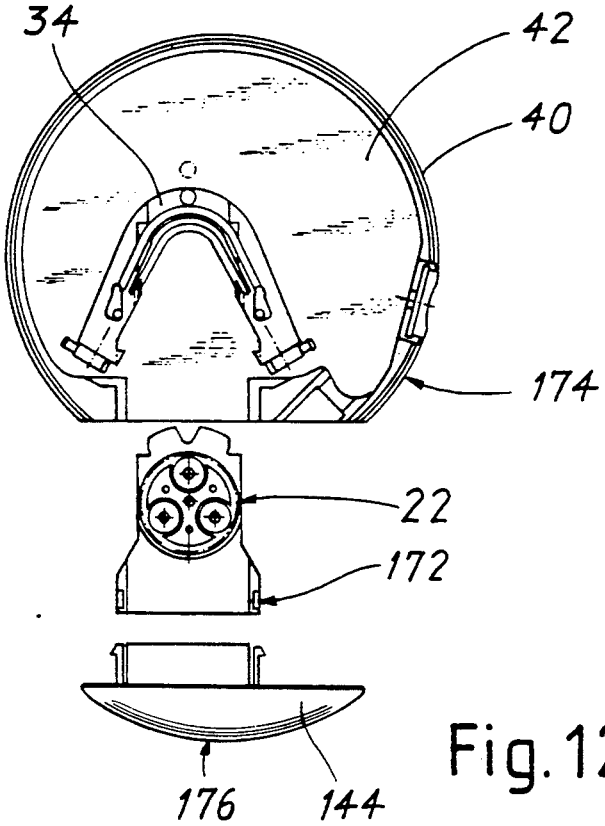
FIG. 12 is a top view of the peristaltic pump according to a second embodiment, the three modules constituting it not having been assembled.
Figure 13:
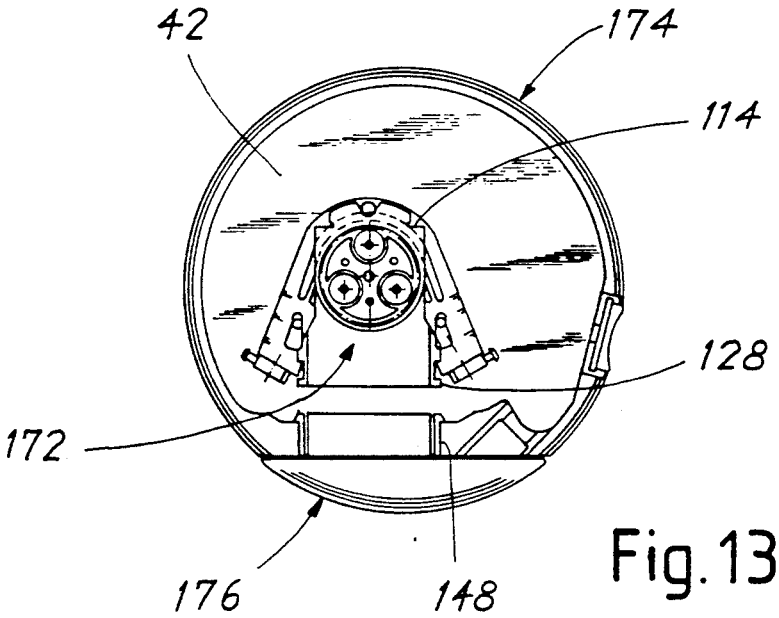
FIG. 13 is a top view similar to FIG. 12, but in which the three modules are assembled.

According to this second embodiment shown on figures 12 and 13, the first module 172 comprises rotor 22 and the motor means, the second module 174 comprises the case 40 in the outwardly opening cavity 42 of which the support piece 34 is secured in a non-removable manner. The first module 172 does not include the gripping head 144 which constitutes a third independent module 176.

During assembly of these three modules, there is assembled during a first stage the first module 172 with the second module 174 thanks to the first positioning means 114 and assembly means 128 thus resolving the pumping problems. In the course of a second stage, one assembles the third module 176 with the second module 174 thanks to the second assembly means 148, such third module simply playing the role of a cover and blocking the outwardly opening cavity 42. One thus resolves the sealing problems.

What I claim is:

1. A peristaltic pump permitting the administration of a liquid substance and formed from at least three modules, said pump comprising:

pumping means comprising a rotor having at least one stage with at least one presser roller, said roller having an operating position for locally compressing at least one tube coupling a reservoir to the output of the pump, said reservoir being for storing said liquid substance, said compression being effected against at least one support piece, said pumping means forming part of a first module and said support piece forming part of a second module, and said first and second modules being provided with first assembly means for forming set of said two modules and defining an optimum distance between each presser roller and the support piece;

motor means for operating said pumping means; and, a third module having an outwardly opening cavity;

said second module being designed to be housed within said cavity of the third module, the first module being designed to be at least partially introduced into said cavity through an intermediate position in which the first module and the second module are assembled by the first assembly means to form said set of two modules, and said set of two modules being designed to be displaced from said intermediate insertion position up to a final insertion position in which it is assembled with the third module by second assembly means so as to seal said first module.

2. A peristaltic pump as set forth in claim 1 wherein the first assembly means is provided respectively on at least one face of the first module and on at least one corresponding face of the support piece.

3. A peristaltic pump as set forth in claim 1 wherein the second assembly means for the set of modules with the third module comprise at least one elastic hook provided on the first module and cooperating with at least one shoulder provided in the internal walls of the outwardly opening cavity of the third module.

4. A peristaltic pump as set forth in claim 1 wherein the third module comprises the storage reservoir for said liquid substance.

5. A peristaltic pump as set forth in claim 1 wherein the first module comprises the motor means.

6. A peristaltic pump as set forth in claim 1 wherein said motor means forms part of said first module.

7. A peristaltic pump as set forth in claim 1 wherein the support piece is a block with two branches which open out to form a substantially V-shaped opening, this block being hollowed out parallel to the bottom of said V-shaped opening within its thickness so as to define at least one elastic wall which is deformable under the action of said presser roller and against which said tube is locally compressed.

8. A peristaltic pump as set forth in claim 7 wherein said support piece is formed of polyoxymethylene.

9. A peristaltic pump as set forth in claim 7 wherein the deformable elastic wall comprises a central portion between two end portions and is thicker at its central portion than at its two end portions.

10. A peristaltic pump as set forth in claim 7 wherein the first assembly means comprises at least one hook provided at the end of one of the two branches of the support piece, said hook cooperating with an undercut provided on the first module, and said support piece being formed of a material giving a certain elasticity to said hook.

11. A peristaltic pump as set forth in claim 1 wherein the first module is introduced into said cavity along a rectilinear path defining an insertion axis.

12. A peristaltic pump as set forth in claim 11 further comprising blocking means for holding the second module in said intermediate insertion position during assembly of the first and second modules, said blocking means being provided on at least one internal face of the outwardly opening cavity of the third module and on at least one corresponding face of the support piece.

13. A peristaltic pump as set forth in claim 12 wherein said blocking means comprises at least one projection provided on said face of the support piece and cooperating with at least one blind orifice provided on said internal face of the outwardly opening cavity.

14. A peristaltic pump as set forth in claim 11 wherein at least one internal face of the outwardly opening cavity of the third module and at least one corresponding face of the support piece comprise guide means for facilitating the displacement of the set of two modules from the intermediate insertion position to the final insertion position.

15. A peristaltic pump as set forth in claim 14 wherein said guide means comprises at least one pine cooperating with at least one corresponding receptacle.

16. A peristaltic pump as set forth in claim 11 further comprising a filling orifice for filling said reservoir, and wherein said first module comprises a gripping head for masking said filling orifice when said first module is in said intermediate insertion position.

17. A peristaltic pump as set forth in claim 11 wherein said assembly of said set of two modules in said intermediate position is irreversible.

* * * * *

UNITED STATES PATENT AND TRADEMARK OFFICE

CERTIFICATE OF CORRECTION

PATENT NO. : 5,249,937

DATED : October 5, 1993

INVENTOR(S) : CHRISTOPHE AUBERT

It is certified that error appears in the above-identified patent and that said Letters Patent is hereby corrected as shown below:

Column 11, line 18, after "forming" insert --a--.

Column 12, line 44, change "pine" to "pin".

Signed and Sealed this

Ninth Day of May, 1995

Bruce Lehman

*Attest:*

BRUCE LEHMAN

*Attesting Officer*

*Commissioner of Patents and Trademarks*